US011500330B2

(12) United States Patent
Sakurai et al.

(10) Patent No.: US 11,500,330 B2
(45) Date of Patent: Nov. 15, 2022

(54) IMAGE FORMING APPARATUS HAVING DEVELOPING DEVICE WITH AIR SUCTION DEVICE

(71) Applicant: Konica Minolta, Inc., Tokyo (JP)

(72) Inventors: Shota Sakurai, Machida (JP); Kei Yuasa, Hino (JP); Takenobu Kimura, Hachioji (JP); Tetsuya Ishikawa, Sagamihara (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/503,767

(22) Filed: Oct. 18, 2021

(65) Prior Publication Data

US 2022/0121151 A1 Apr. 21, 2022

(30) Foreign Application Priority Data

Oct. 19, 2020 (JP) ..... JP2020-175061

(51) Int. Cl.
*G03G 15/08* (2006.01)
*G03G 21/00* (2006.01)
*G03G 21/20* (2006.01)

(52) U.S. Cl.
CPC ..... *G03G 21/206* (2013.01); *G03G 15/0898* (2013.01); *G03G 2221/1645* (2013.01)

(58) Field of Classification Search
CPC ..... G03G 15/0844; G03G 21/206; G03G 2221/1645; G03G 15/0898
USPC ..... 399/92, 98, 99, 264
See application file for complete search history.

(56) References Cited

U.S. PATENT DOCUMENTS 6,112,040 A * 8/2000 Saito ..... B41J 29/17 399/93
6,424,810 B1 * 7/2002 Chappell ..... G03G 15/0898 399/92
10,877,400 B1 * 12/2020 Kuramoto ..... G03G 21/206
2010/0296834 A1 * 11/2010 Omori ..... G03G 15/0898 399/99
2020/0183325 A1 * 6/2020 Park ..... G03G 21/0005

FOREIGN PATENT DOCUMENTS

JP 2015-060013 A 3/2015
JP 2016-090879 A 5/2016
JP 2021051164 A * 4/2021

* cited by examiner

*Primary Examiner* — Robert B Beatty
(74) *Attorney, Agent, or Firm* — Squire Patton Boggs (US) LLP

(57) ABSTRACT

Provided is an image forming apparatus including an image carrier, an exposure device, a developing device that supplies a developer to form a toner image, and a hardware processor that controls the image carrier, the exposure device, and the developing device. The image forming apparatus further includes a fume prevention plate that covers a part of an internal space of the developing device where the developing roller is disposed and the developer is stored and that prevents the developer from scattering outside from the internal space, a suction duct, and an air suction device. One end of the suction duct is connected to the internal space and another end of the suction duct is connected to the air suction device. The fume prevention plate includes a movable portion. A position of the movable portion can be changed between a first position and a second position different from the first position.

19 Claims, 10 Drawing Sheets

IMAGE FORMING APPARATUS HAVING DEVELOPING DEVICE WITH AIR SUCTION DEVICE

CROSS-REFERENCE TO RELATED APPLICATIONS

The entire disclosure of Japanese Patent Application No. 2020-175061 filed on Oct. 19, 2020 is incorporated herein by reference in its entirety.

BACKGROUND

Technological Field

The present invention relates to an image forming apparatus.

Description of the Related Art

Conventionally, there have been proposed techniques of sucking and removing toner scattered from a developing device in an electrophotographic image forming apparatus (JP 2015-060013 A, JP 2016-090879 A).

Scattered toner contaminates the inside of the image forming apparatus and causes errors such as a stained image. Thus, there have been known image forming apparatuses with a suction duct for sucking and removing scattered toner. It is thereby possible to suck and remove the toner scattered from the developing device through the suction duct, suppressing contamination in the image forming apparatus.

JP 2015-060013 A discloses a developer collection device that is provided with a suction inlet that can be opened and closed on the suction duct for scattered toner and that can suck the developer in the suction duct from the outside of the suction duct. There needs to be a service person who detaches the developing device and manually cleans the toner accumulated in the duct using a vacuum cleaner.

An image forming apparatus disclosed in JP 2016-090879 A includes a blowing means to blow air to a wall of a suction duct and removes toner attached to the wall of the suction duct by air blowing in view of a problem as follows: in a device that sucks and reduces toner scattered from a developing device with a suction duct, the scattered toner is accumulated on the wall of the suction duct (especially near the opening), and the accumulated toner falls off when some kind of vibration is applied to cause an image stain. As air is blown when image formation is not being performed, the attached toner is collected by a cleaning unit and does not get on an image even if it is attached to a photoreceptor or a developing roller.

SUMMARY

In an image forming apparatus configured to suck and reduce toner scattered from a developing device with a suction duct, developer (which may be toner only (the same shall apply hereinafter)) is accumulated on a fume prevention plate that prevents the developer from scattering outside from the internal space of the developing device, which may cause toner spill that affects the images.

Conventionally, developer is easily accumulated, and the accumulated developer is not easily removed, as the fume prevention plate is fixed.

In the image forming apparatus disclosed in JP 2016-090879 A, the accumulated developer is blown off and wound up. Thus, there is a necessity of cleaning and removing the developer. In addition, the image forming apparatus requires an air blowing mechanism separately, and it is necessary to maintain setting space of an air duct for blowing air individually from the suction duct.

The present invention has been conceived in view of the above-described problems in the prior art, and has an object of removing developer on a fume prevention plate of a developing device efficiently and effectively in an image forming apparatus configured to suck and reduce developer scattering from the developing device with a suction duct.

To achieve at least one of the abovementioned objects, an image forming apparatus reflecting one aspect of the present invention includes:

an image carrier;

an exposure device that draws an electrostatic latent image on the image carrier;

a developing device that supplies, using a developing roller facing the image carrier, a developer to the electrostatic latent image formed on the image carrier to form a toner image; and a hardware processor that controls the image carrier, the exposure device, and the developing device, wherein the image forming apparatus further includes:

a fume prevention plate that covers a part of an internal space of the developing device where the developing roller is disposed and the developer is stored and that prevents the developer from scattering outside from the internal space;

a suction duct; and an air suction device, wherein one end of the suction duct is connected to the internal space and another end of the suction duct is connected to the air suction device, wherein the fume prevention plate includes a movable portion, wherein a position of the movable portion can be changed between a first position and a second position different from the first position.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention, wherein.

DETAILED DESCRIPTION OF THE EMBODIMENTS

Hereinafter, an embodiment of the present invention is described with reference to the drawings. The following is an embodiment of the present invention and does not limit the present invention.

[Configuration of Image Forming Apparatus]

Figure 1:
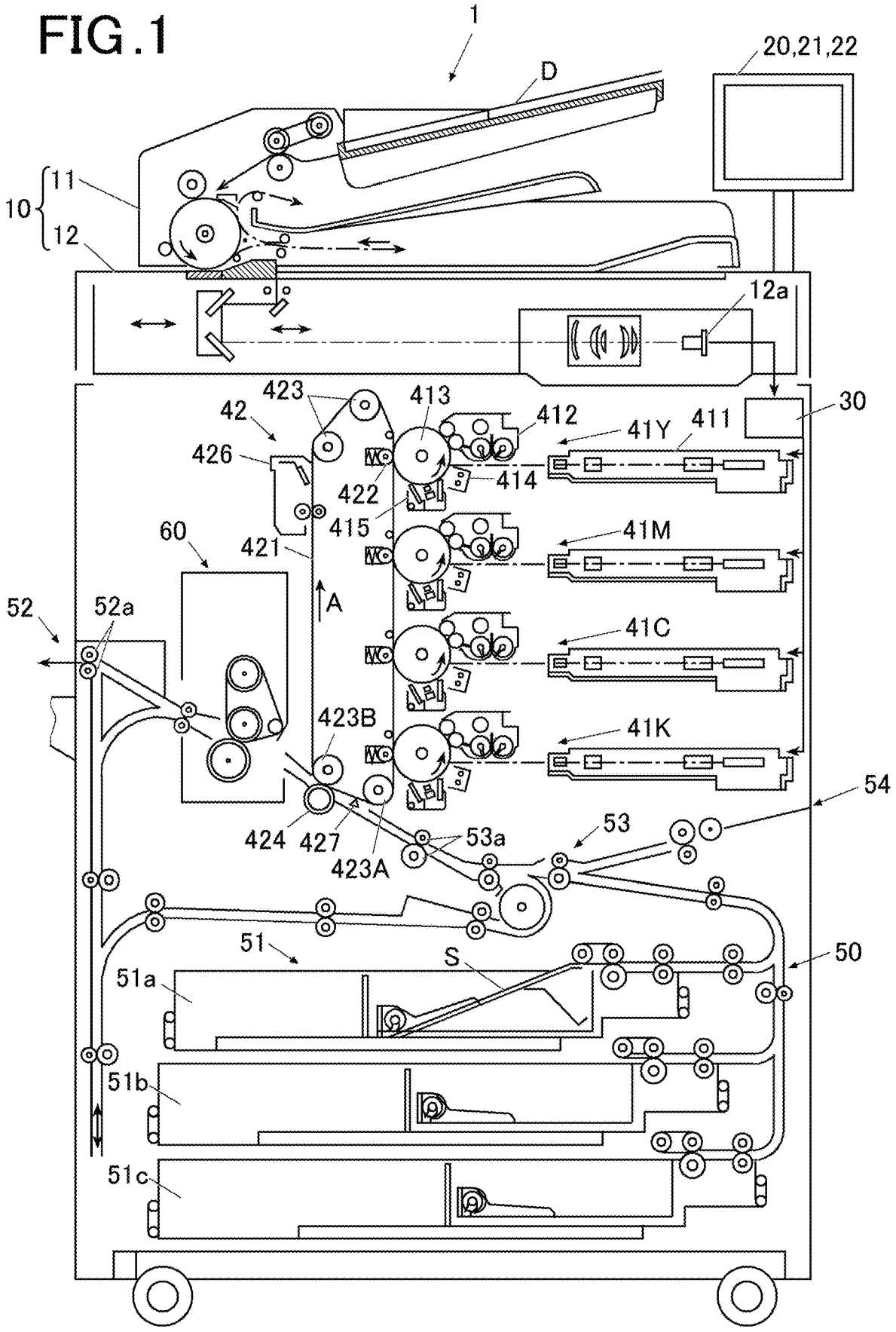
FIG. 1 schematically shows an overall configuration of an image forming apparatus.
Figure 2:
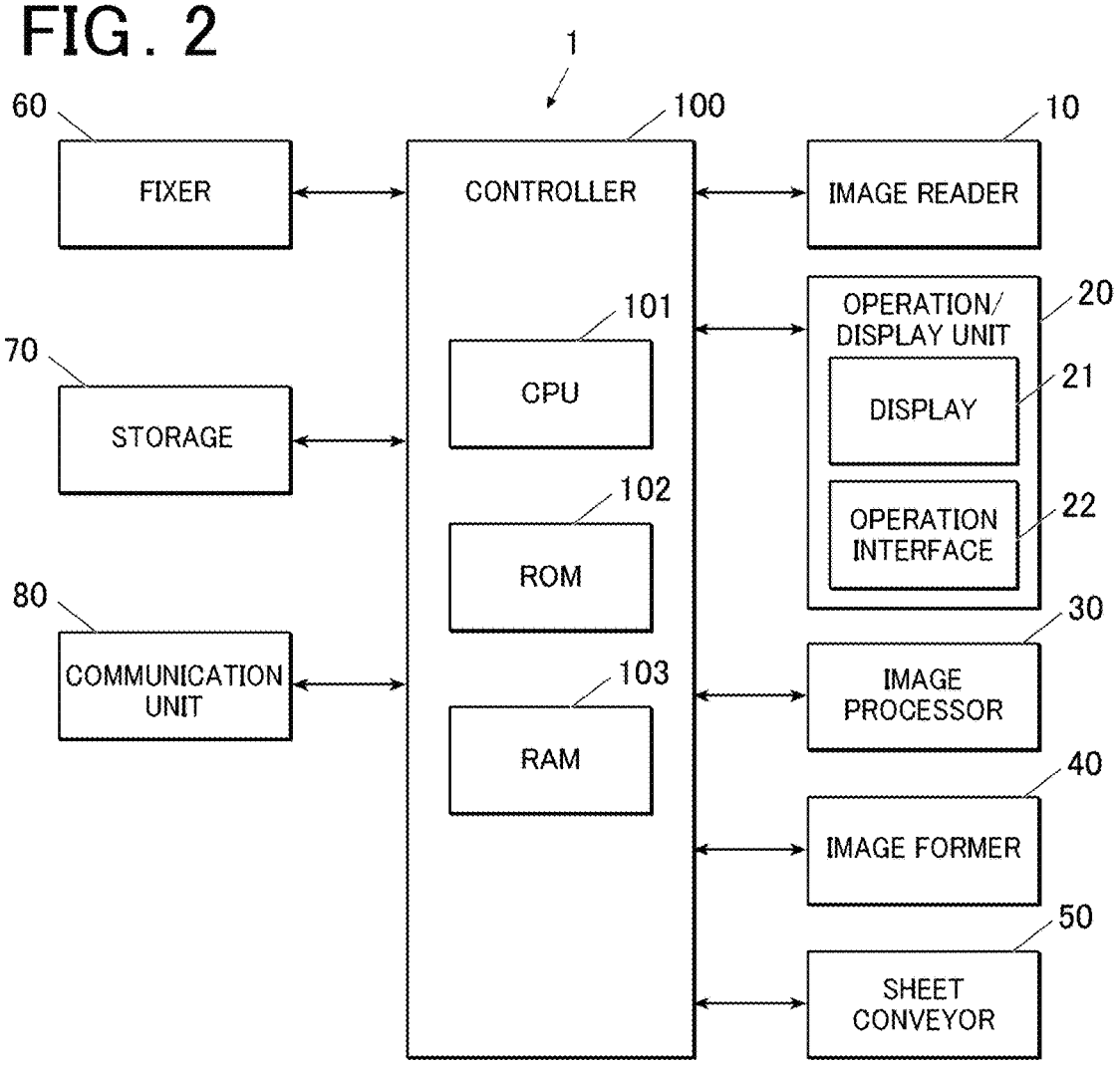
FIG. 2 is a block diagram showing a functional configuration of the image forming apparatus.

FIG. 1 schematically shows an overall configuration of an image forming apparatus 1 in this embodiment. FIG. 2 is a block diagram showing a main functional configuration of the image forming apparatus 1 in this embodiment.

The image forming apparatus 1 shown in FIGS. 1, 2 is an electrophotographic color image forming apparatus using an intermediate transfer system. In the image forming apparatus 1, toner images formed with colors of yellow (Y), magenta (M), cyan (C), and black (K) on photoconductive drums 413 are transferred onto an intermediate transfer belt 421 (first transfer) so as to be superposed on one another, and the toner image of four colors is transferred onto a sheet of paper (second transfer). An image is thereby formed.

The image forming apparatus 1 employs the tandem method in which the photoconductive drums for the four colors of Y, M, C, and K are disposed in series in the running direction of the intermediate transfer belt 421 and the toner images of the respective colors are sequentially transferred onto the intermediate transfer belt 421.

As shown in FIG. 2, the image forming apparatus 1 includes an image reader 10, an operation/display unit 20, an image processor 30, an image former 40, a sheet conveyer 50, a fixer 60, a storage 70, a communication unit 80, and a controller 100 (hardware processor).

The controller 100 includes a central processing unit (CPU) 101, a read only memory (ROM) 102, and a random access memory (RAM) 103. The CPU 101 reads out the program corresponding to the processing from the ROM 102, loads the program to the RAM 103, and centrally controls the operation of each block of the image forming apparatus 1 shown in FIG. 2 in cooperation with the loaded program.

The image reader 10 includes an automatic document sheet feeding device 11 called an auto document feeder (ADF) and a document image scanning device 12 (scanner).

The automatic document sheet feeding device 11 conveys a document D placed on the document tray with the conveyance mechanism to the document image scanning device 12. The automatic document sheet feeding device 11 can continuously and ceaselessly read images (on double faces) of a number of sheets of the document D placed on the document tray at once.

The document image scanning device 12 reads the document image by optically scanning the document transferred onto the platen glass from the automatic document sheet feeding device 11 or placed on the platen glass and imaging the reflected light from the document on the receiving face of a CCD (charge coupled device) sensor 12*a*. The image reader 10 generates input image data based on the reading results by the document image scanning device 12. The input image data is processed by predetermined image processing in the image processor 30.

The operation/display unit 20 is, for example, a liquid crystal display (LCD) with a touch panel, and functions as a display 21 and an operation interface 22. The display 21 displays various operation screens, image conditions, and operation states of the functional components according to display control signals input from the controller 100. The operation interface 22 includes various operation keys such as numeric keys and a start key, and the operation interface 22 receives various input operations by the user and outputs operation signals to the controller 100.

The image processor 30 includes a circuit that processes image data (input image data) of an input job by digital image processing according to the initial setting or the user setting. For example, the image processor 30 performs gradation correction based on gradation correction data (gradation correction table) under the control of the controller 100. The image processor 30 processes the input image data by various kinds of correction such as color correction and shading correction and compression processing in addition to gradation correction. The image former 40 is controlled based on the image data processed as described above.

The image former 40 includes image forming units 41Y, 41M, 41C, and 41K, for forming images of colored toners of components Y, M, C, and K based on the processed image data and an intermediate transfer unit 42.

The image forming units 41Y, 41M, 41C, and 41K for components Y, M, C, and K are configured in the same way. For convenience of illustration and description, the parts common to the image forming units 41Y, 41C, 41M, and 41K are denoted by the same reference numerals. In order to distinguish each of the common components, "Y", "M", "C", or "K" is added to the corresponding reference numeral. In FIG. 1, only the components of the image forming unit 41Y for the Y color component have reference numerals, and the reference numerals of the components of the other image forming units 41M, 41C, and 41K are omitted.

Each image forming unit 41 includes an exposure device 411, a developing device 412, a photoconductive drum 413 (image carrier), a charging device 414, and a drum cleaning device 415.

The photoconductive drum 413 is, for example, a negatively chargeable organic photoconductor (OPC) in which an under coat layer (UCL), a charge generation layer (CGL), and a charge transport layer (CTL) are laminated in order on the peripheral surface of an electroconductive cylindrical aluminum body (aluminum tube). The CGL consists of an organic semiconductor made of a resin binder (e.g. polycarbonate resin) and a charge generation material (e.g. phthalocyanine pigment) dispersed in the resin binder. The CGL generates pairs of positive charges and negative charges when exposed by the exposure device 411. The CTL consists of a resin binder (e.g. polycarbonate resin) and a hole transport material (electron-donating nitrogen-containing compounds) dispersed in the resin binder. The CTL transfers the positive charges generated at the CGL to the surface of the CTL.

The controller 100 causes the photoconductive drums 413 to rotate at a constant peripheral speed (e.g., 665 mm/s) by regulating driving signals sent to a driving motor(s) (not shown in the drawings) that rotates the photoconductive drums 413.

The charging device 414 negatively and uniformly charges the surface of the photoconductive drum 413. The exposure device 411 consists of a semiconductor laser, for example and emits laser light corresponding to images of its color component onto the photoconductive drum 413. The positive charges generated at the CGL of the photoconductive drum 413 by the exposure are transferred to the surface of the CTL and neutralize the negative charges on the surface of the photoconductive drum 413. Accordingly, an electrostatic latent image of the corresponding color component is formed on the surface of the photoconductive drum 413 by the electric potential difference between the exposed and non-exposed regions.

The developing device 412 uses a two-component developer that contains toner and carrier. The developing device 412 causes toner of its color component to adhere to the surface of the photoconductive drum 413 to visualize the electrostatic latent image. The developing device 412 thereby forms a toner image.

Figure 3:
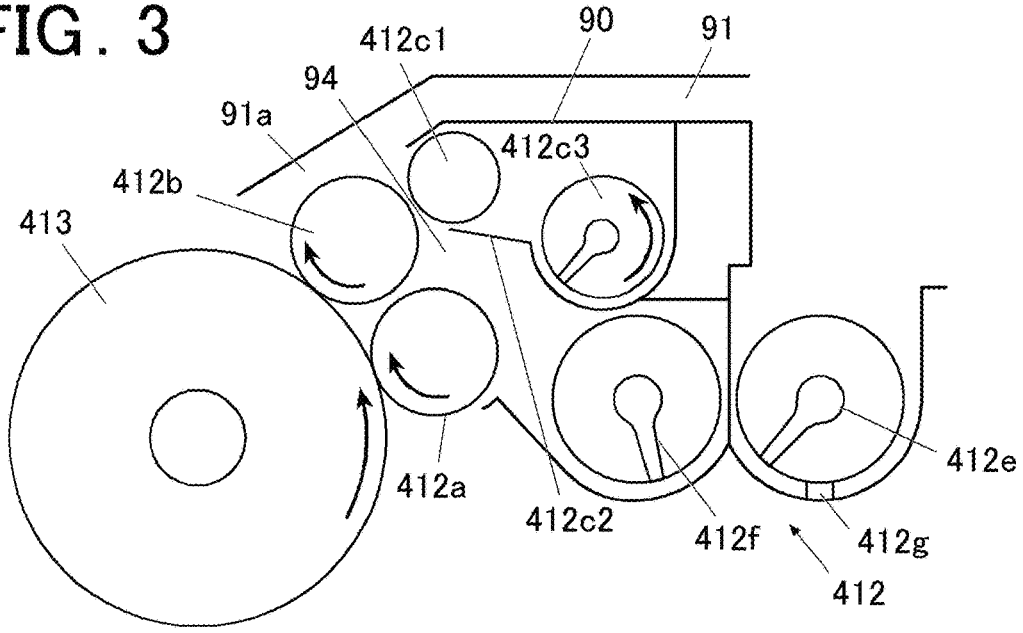
FIG. 3 is a cross-sectional view of a schematic configuration of a developing device.

Hereinafter, the configuration of the developing device 412 is described in detail with reference to FIG. 3. The developing device 412 forms a toner image on the surface of the photoconductive drum 413 by causing toner of the corresponding color component to adhere to the surface of the photoconductive drum 413. As shown in FIG. 3, the developing device 412 includes a first developing roller 412*a*, a second developing roller 412*b*, a collecting roller 412*c*1, a stirring roller 412*e*, a conveying roller 412*f*, and a sensor 412*g*.

The first developing roller 412*a* and the second developing roller 412*b* each include a rotatable developing sleeve and a developing magnet roll provided inside the developing sleeve. The first developing roller 412*a* and the second developing roller 412*b* are placed close to the photoconductive drum 413 and deliver the developer to their respective developing areas close to the photoconductive drum 413. More specifically, the first developing roller 412*a* and the second developing roller 412*b* rotate in the same direction, and the upstream first developing roller 412*a* delivers the developer to the downstream second developing roller 412*b* to convey the developer to their respective developing areas. The developing sleeves rotate clockwise in the drawings. The developing magnet roll houses multiple magnetic poles that generate a magnetic field.

The collecting roller 412*c*1 for collecting excess developer is placed close to the second developing roller 412*b*. The collecting roller 412*c*1 is a developer carrier that carries the developer with magnetic force which also includes a rotatable developing sleeve and a developing magnet roll provided inside the developing sleeve.

The toner collected by the collecting roller 412*c*1 is conveyed to the stir-and-convey member 412*c*3 via the guide member 412*c*2, and then conveyed by the stir-and convey member 412*c*3 to a store room of the stirring roller 412*e* or the conveying roller 412*f*.

The stirring roller 412*e* and the conveying roller 412*f* are spiral-shaped screw members. The stirring roller 412*e* rotates to stir and mix the toner and carrier, so that the toner and carrier are charged by friction. The developer charged by friction is conveyed from the stirring roller 412*e* to the conveying roller 412*f*. The conveying roller 412*f* rotates to convey the charged developer to the developing roller 412*a*.

The sensor 412*g* is placed close to the stirring roller 412*e* to detect the toner density. On the basis of the detection result by the sensor 412*g*, a supplying unit (not shown in the drawings) supplies developer according to the amount of the consumed toner.

When the developer arrives at the first developing roller 412*a*, the developer forms magnetic brushes on the outer circumferential surface of the developing sleeve owing to the magnetic field generated by the developing magnet roll of the first developing roller 412*a*. Accordingly, layers of developer are formed on the outer circumferential surface of the developing sleeve. The developing sleeve rotates clockwise in the drawings while holding the developer on its outer circumferential surface with the magnetic field to convey the developer to the developing area, where the developing sleeve is closest to the photoconductive drum 413. In the developing area, the toner is electrostatically moved to the electrostatic latent image formed on the photoconductive drum 413 from the developing sleeve of the first developing roller 412*a*. On the other hand, part of the developer of the developing sleeve on the first developing roller 412*a* is passed on to the second developing roller 412*b* by the force of the magnetic field. As with the first developing roller 412*a*, the second developing roller 412*b* forms layers of developer on the developing sleeve, and the developer is moved to the photoconductive drum 413 in the developing area.

The developing device 412 thereby supplies toner to the photoconductive drum 413 to make the electrostatic latent image visible with toner. The developing device 412, which includes the first developing roller 412*a* and the second developing roller 412*b*, can secure developing areas to form high-quality images.

The type of carrier is not specifically limited. A well-known widely used carrier can be used, such as a binder carrier and a coated carrier. The diameter of a carrier particle is preferably 15 to 100 μm, but is not limited thereto.

Similarly, the type of toner is not specifically limited. A well-known widely used toner can be used. For example, a binder resin that contains a colorant and as necessary a charge controlling agent and/or a separating agent and that is treated with an external additive can be used. The diameter of a toner particle is preferably around 3 to 15 μm but is not limited thereto.

The drum cleaner 415 has a drum cleaning blade or the like that slidingly contacts the surface of the photoconductive drum 413. The drum cleaner 415 removes the residual toner on the surface of the photoconductive drum 413 after the first transfer.

The intermediate transfer unit 42 includes an intermediate transfer belt 421, first transfer rollers 422 (transfer members), supporting rollers 423, a second transfer roller 424, a belt cleaner 426, and a sensor 427.

The intermediate transfer belt 421 is an endless belt and is stretched around the supporting rollers 423 to be a loop. At least one of the supporting rollers 423 is a driving roller, and the others are driven rollers. For example, the roller 423A, which is provided downstream from the first transfer roller 422 for the K-color component in the moving direction of the belt, is preferable as the driving roller. This makes it easy to keep the moving speed of the belt uniform at the first transfer points. Rotation of the driving roller 423A makes the intermediate transfer belt 421 move at a constant speed in the direction of the arrow A.

The first transfer rollers 422 are provided at the inner circumferential surface side of the intermediate transfer belt 421 so as to face their respective photoconductive drums 413. Each of the first transfer rollers 422 is pressed against the corresponding photoconductive drum 413 with the intermediate transfer belt 421 in between to form a first transfer nip part. At the first transfer nip part, a toner image is transferred from the photoconductive drum 413 to the intermediate transfer belt 421.

The second transfer roller 424 is provided on the outer circumferential surface side of the intermediate transfer belt 421 so as to face the roller 423B (hereinafter called backup roller 423B), which is provided downstream from the driving roller 423A in the belt moving direction. The second transfer roller 424 is pressed against the backup roller 423B with the intermediate transfer belt 421 in between to form a second transfer nip part. At the second transfer nip part, a toner image is transferred from the intermediate transfer belt 421 to a sheet of paper.

When the intermediate transfer belt 421 passes through the first transfer nip parts, the toner images formed on the surfaces of the photoconductive drums 413 are sequentially transferred onto the intermediate transfer belt 421 so as to be superposed on top of one another (first transfer). More specifically, a first transfer bias is applied to each first transfer roller 422, so that charges having reverse polarity to that of the toner are given to the inner surface side of the intermediate transfer belt 421 (the side abutting the first transfer rollers 422). Accordingly, the toner images are electrostatically transferred onto the intermediate transfer belt 421.

Thereafter, when the sheet passes through the second transfer nip part, the toner image on the intermediate transfer belt 421 is transferred onto the sheet (second transfer). More specifically, a second transfer bias is applied to the second transfer roller 424, so that charges having reverse polarity to that of the toner are given to the inner surface side of the sheet (the side abutting the second transfer roller 424). Accordingly, the toner image is electrostatically transferred onto the sheet. The sheet on which the toner image is transferred is then conveyed to the fixer 60.

The belt cleaner 426 includes a belt cleaning blade 426 that slidingly contacts the surface of the intermediate transfer belt 421 and removes the toner remaining on the surface of the intermediate transfer belt 421 after the second transfer. Instead of the second transfer roller 424, a belt-type second transfer unit may be used. The belt-type second transfer unit has a second transfer belt stretched around supporting rollers including a second transfer roller to be a loop.

The sensor 427 is placed between the roller 423A and the roller 423B so as to face the surface of the intermediate transfer belt 421, for example. The sensor 427 detects the amount of toner adhering to the intermediate transfer belt 421. The sensor 427 is, for example, an optical reflection density sensor and is usable for controlling the image density.

The fixer 60 heats and pressurizes, at a fixing nip part, the conveyed sheet on which the toner image has been transferred by the second transfer to fix the toner image to the sheet.

The sheet conveyer 50 includes a sheet feeder 51, a sheet ejector 52, and a conveyance path unit 53. The sheet feeder 51 has three sheet feeding tray units 51*a*, 51*b*, and 51*c* that house sheets of paper (standardized paper and/or special paper) by predetermined types, the sheets being sorted according to the basis weight and/or the size. The conveyance path unit 53 has pairs of conveying rollers, such as a pair of register rollers 53*a*.

The sheets housed in the sheet feeding tray units 51*a* to 51*c* are sent out one by one from the top and conveyed to the image former 40 by the conveyance path unit 53. A register roller unit having the pair of register rollers 53*a* registers the fed sheet and adjusts timing of conveying the sheet. The image former 40 transfers the toner image on the intermediate transfer belt 421 onto one side of the sheet as the second transfer. The fixer 60 then performs fixing on the sheet. The sheet on which the image has been formed is ejected outside the apparatus by the sheet ejector 52 that has sheet ejecting rollers 52*a*.

The sheets may be long paper or rolled paper. The sheet of long paper/rolled paper is stored in a sheet feeding device (not shown in the drawings) connected to the image forming apparatus 1. The sheet is supplied to the image forming apparatus 1 from the sheet feeding device through the sheet feeding opening 54 and then sent out to the conveyance path unit 53.

The storage 70 consists of, for example, a nonvolatile semiconductor memory (flash memory) and/or a hard disc drive. The storage 70 stores various kinds of data including information on various settings of the image forming apparatus 1.

The communication unit 80 consists of a communication control card, such as a local area network (LAN) card, and exchanges data with external devices (e.g. personal computer) connected to communication networks, such as a LAN and a wide area network (WAN).

[Suction Cleaning of Scattered Toner]

Next, a technique of suction cleaning of scattered toner produced at the developing device is described.

Figure 4:
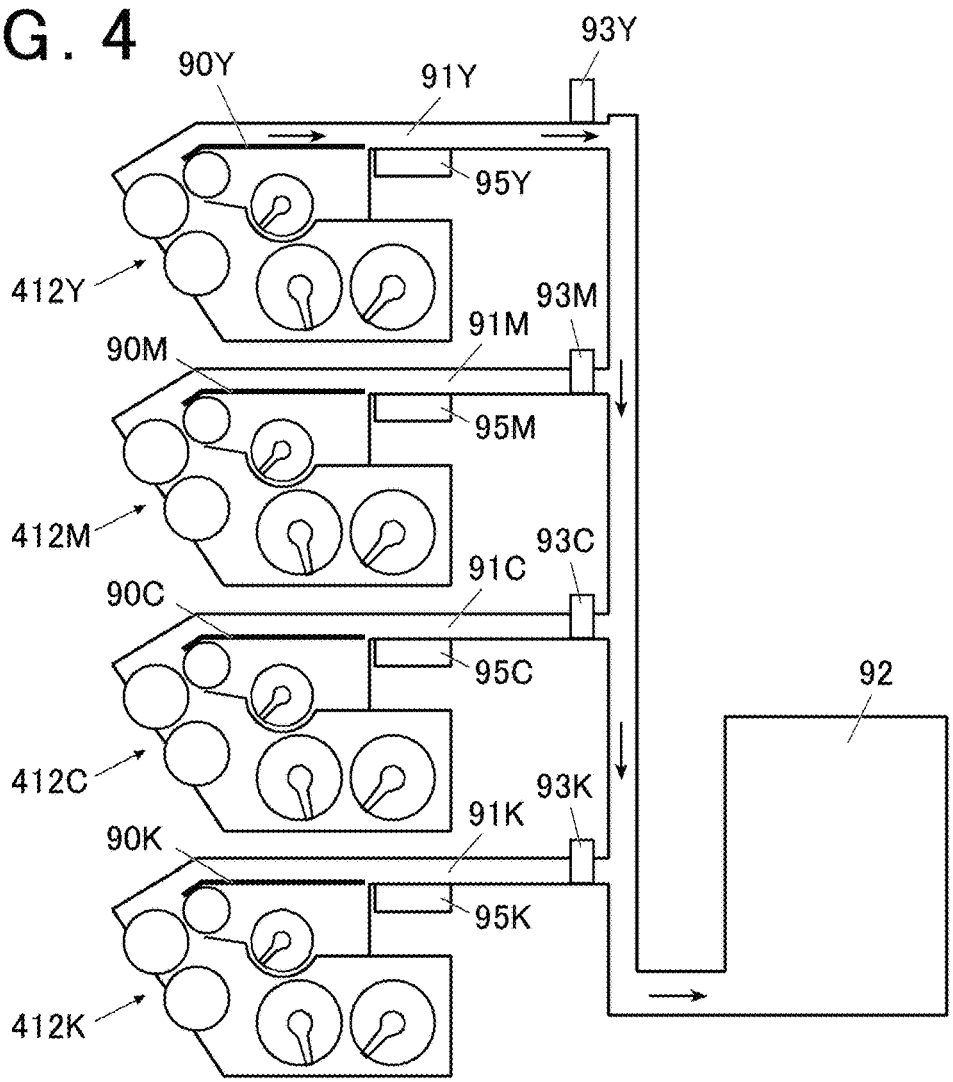
FIG. 4 is a cross-sectional view of a structure of suction from developing devices of four colors.

The image forming apparatus 1 includes a fume prevention plate 90 (Y, M, C, K), a suction duct 91 (Y, M, C, K), and a closing valve 93 (Y, M, C, K) in each developing device 412, and an air suction device 92 (FIG. 4) as shown in FIG. 3 or 4.

The fume prevention plate 90 covers part of an internal space 94 of the developing device 412 where the developing roller 412 *a, b* are placed and the developer is stored so as to prevent the toner from scattering outside of the internal space 94.

The fume prevention plate 90 covers the upper part of the internal space 94, and a suction opening 91*a* of the suction duct 91 is provided above the developing roller 412*b*. The suction opening 91*a* of the suction duct 91 is provided adjacent to the end of the fume prevention plate 90 near the developing roller 412*b*. Part of the end of the fume prevention plate 90 near the developing roller 412*b* is a movable portion 90*a* as shown in FIGS. 5 and 6.

The suction opening 91*a*, which is an end of the suction duct 91 is connected to the internal space 94 as described above.

The other end of the suction duct 91 is connected to the air suction device 92, merging into the other suction ducts 91 of colors, as shown in FIG. 4. The closing valves 93 (Y, M, C, K) are provided for the respective suction ducts 91 (Y, M, C, K) of colors before the merge, as shown in FIG. 4.

Figure 5:
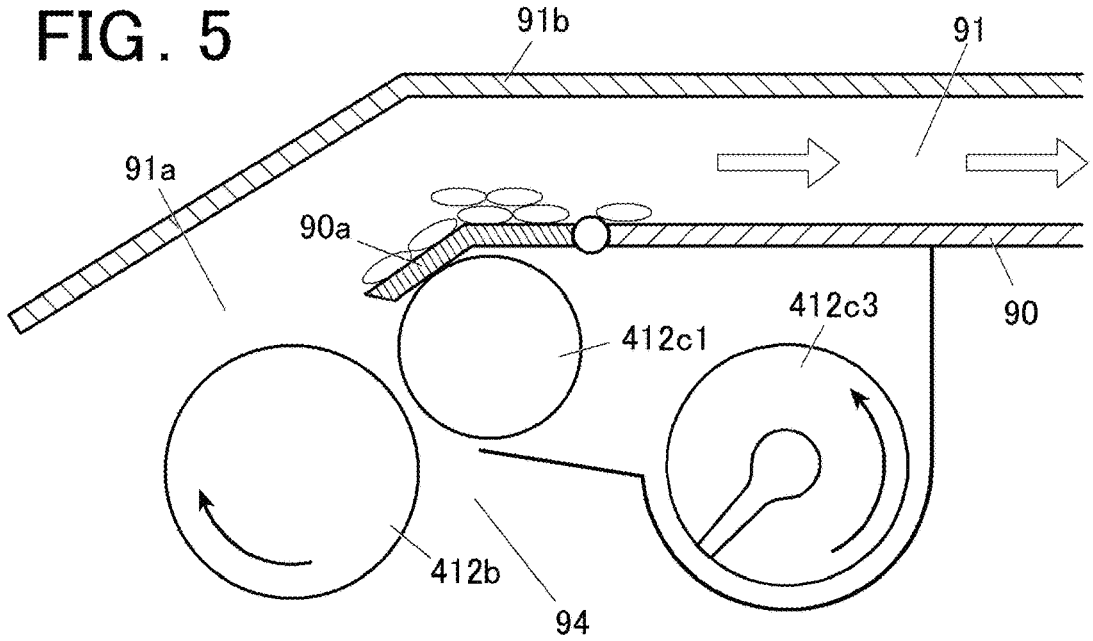
FIG. 5 is a cross-sectional view of a structure of suction from a developing device.
Figure 6:
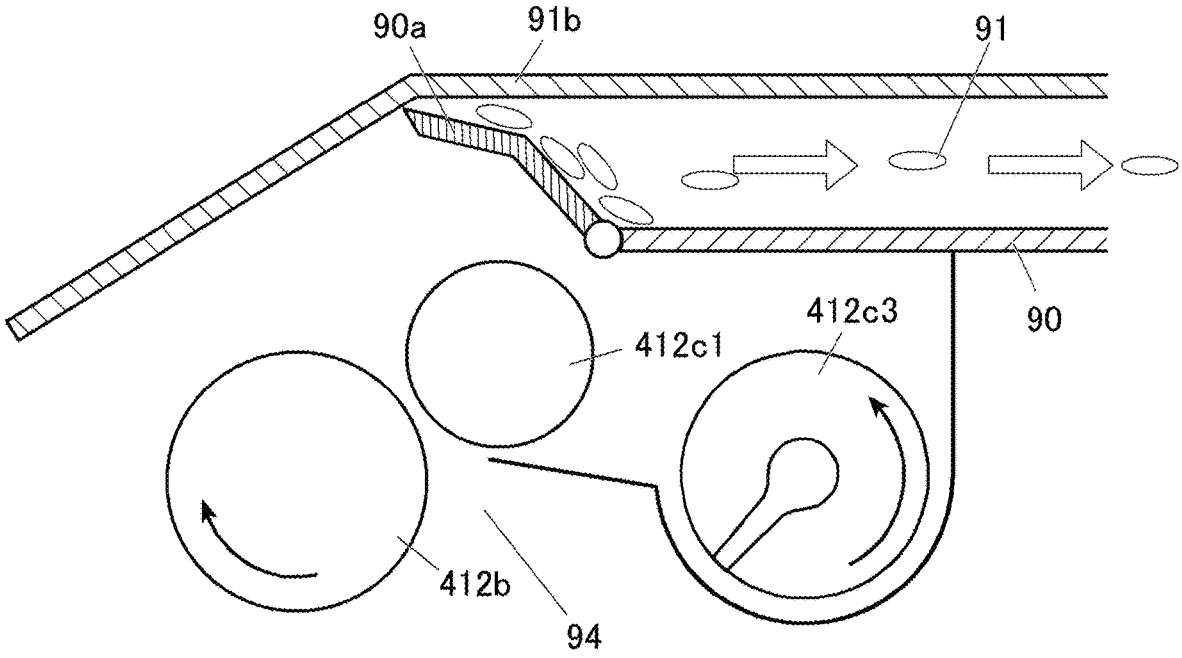
FIG. 6 is a cross-sectional view of a structure of suction from a developing device.

The movable portion 90*a* can change its position between the first position shown in FIG. 5 and the second position shown in FIG. 6 different from the first position, and the controller 100 regulates the position of the movable portion 90*a* to the first position (FIG. 5) and the second position (FIG. 6). The movable support mechanism of the movable portion 90*a* is realized in this embodiment as the end of the movable portion 90*a* on the suction direction side is movably supported by a hinge fulcrum, but is not particularly limited thereto.

The developer scattered at the time of development can be sucked and removed by suction through the suction opening

91*a* via the suction duct 91 when the movable portion 90*a* is at the first position as shown in FIG. 5. The controller 100 performs the image forming operation only when the movable portion 90*a* is at the first position as shown in FIG. 5, and operates the air suction device 92 to perform suction removal of the scattered developer.

On the other hand, the controller 100 controls the suction mode of sucking the internal space 94 via the suction duct 91 with the air suction device 92 except at the time of image formation.

Figure 7:
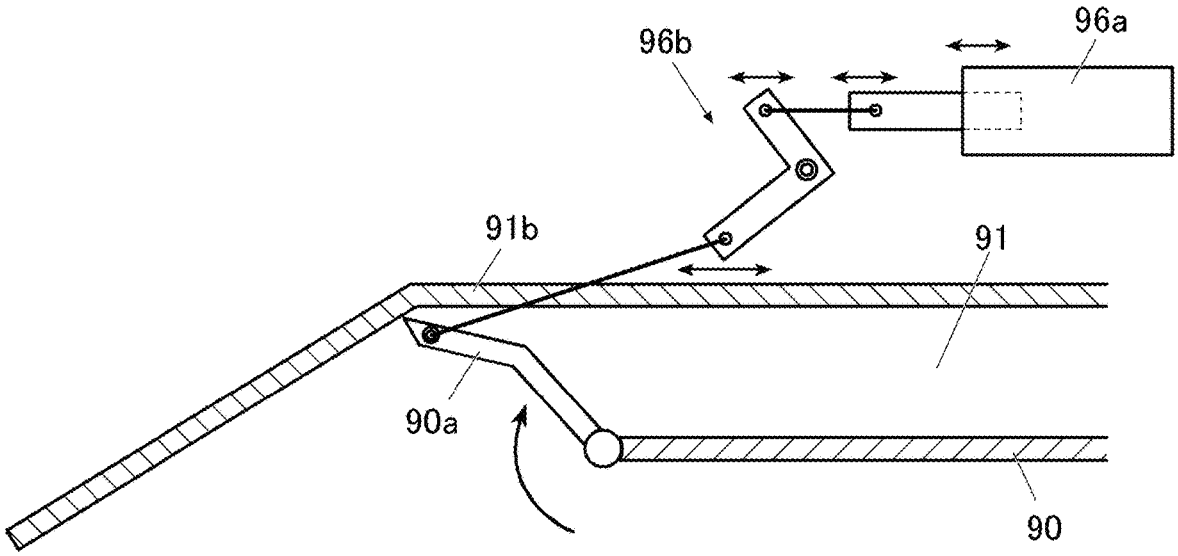
FIG. 7 is a cross-sectional view of a structure of suction from a developing device.

The controller 100 moves the movable portion 90*a* from the first position to the second position in the suction mode (during suction). The device for moving the movable portion 90*a* may consist of a solenoid 96*a* and a link mechanism 96*b* as shown in FIG. 7, for example, but is not limited thereto.

The movable portion 90*a* is not moved at the time of image formation and fixed to the first position. This prevents toner spill that influences an image.

The controller 100 moves the movable portion 90*a* in the suction mode. When the movable portion 90*a* is moved to the second position (from FIG. 5 to FIG. 6), part of the developer accumulated on the movable portion 90*a* may fall inside the suction duct 91. The developer falling from the movable portion 90*a* is removed by suction because it is in the suction mode.

As shown in FIG. 5, the movable portion 90*a* is disposed along the collecting roller 412*c*1 (developer carrier) at the first position. When the movable portion is at the first position, the suction path of the suction duct 91 is provided on the opposite side of the collecting roller 412*c*1 with the movable portion 90*a* of the fume prevention plate 90 in between.

The movable portion 90*a* is more separate from the collecting roller 412*c*1 at the second position of FIG. 6 than at the first position of FIG. 5. Being separated from the collecting roller 412*c*1 at the second position, the movable portion 90*a* is less influenced by the magnetic force from the collecting roller 412*c*. Thus, the developer easily falls from the movable portion 90*a*.

The upper face of the movable portion 90*a* at the first position on which the developer is likely to be accumulated forms the lower face of the suction duct 91, and the upper face of the movable portion 90*a* at the second position is inclined downward in the suction direction. The developer then falls from the movable portion 90*a* into the suction duct 91 on the suction direction side further from the movable portion 90*a*.

In summary, the developer accumulated on the movable portion 90*a* is sucked toward the air suction device 92 and removed effectively and effectively by the reaction when the movable portion 90*a* is moved from the first position to the second position, the reduction of magnetic force acting from the collecting roller 412*c*1, the gravity that causes the developer to fall along the downward inclination, and the suction force.

In order that the developer falls from the movable portion 90*a* into the suction duct 91, the following operations may be performed under the control of the controller 100.

One way is to move the movable portion 90*a* to and fro in the suction mode. The controller 100 moves the movable portion 90*a* from the second position toward the first position and then back to the second position (to and fro) one time or multiple times in the suction mode. This increases the possibility that the developer that has not fallen in the first movement fall from the movable portion 90*a*.

It is preferable that each of the developing devices 412 undergoes the suction mode individually. The suction force of the air suction device 92 is concentrated on one of the developing devices 412, realizing efficient suction.

When the developing device 412Y undergoes the suction mode, the controller 100 causes the air suction device 92 to perform the suction while the closing valve 93Y is open as shown in FIG. 4 and the closing valves 93M, 93C, and 93K are closed, and the controller 100 controls the operation of the movable portion 90*a* of the fume prevention plate 90Y and the operation of the vibrating device 95Y. The other developing device 412M, 412C, or 412K undergoes the suction mode while the suction path to the concerning developing device is opened and the other paths are closed by the open/close control of the closing valves 93 (Y, M, C, K).

(Second Suction Path)

In the above example, regardless of whether the movable portion 90*a* is at the first position or the second position, the suction path of the suction duct 91 is between the fume prevention plate 90 and the upper face member 91*b*. When the movable portion 90*a* is at the second position, air is blown from the space between the end of the movable portion 90*a* and the upper face member 91*b*.

Here, when the movable portion 90*a* is at the first position, the suction path of the suction duct 91 is the first suction path, and when the movable portion 90*a* is at the second position, the suction path of the suction duct 91 is the second suction path.

The first suction path and the second suction path may be different from each other. The first suction path is designed focusing on suction of fumes of the developer from the internal space 94, and the second suction path is designed focusing on removal of the developer accumulated inside the suction duct 91.

Figure 8:
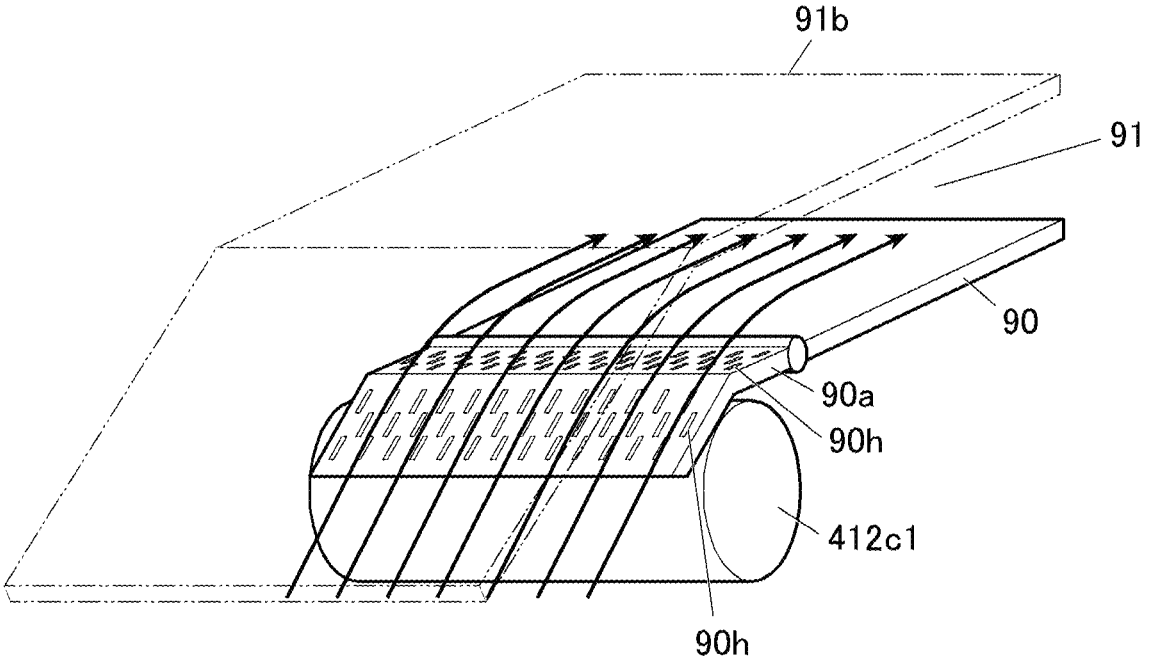
FIG. 8 is a perspective view of a structure of suction from a developing device.
Figure 9:
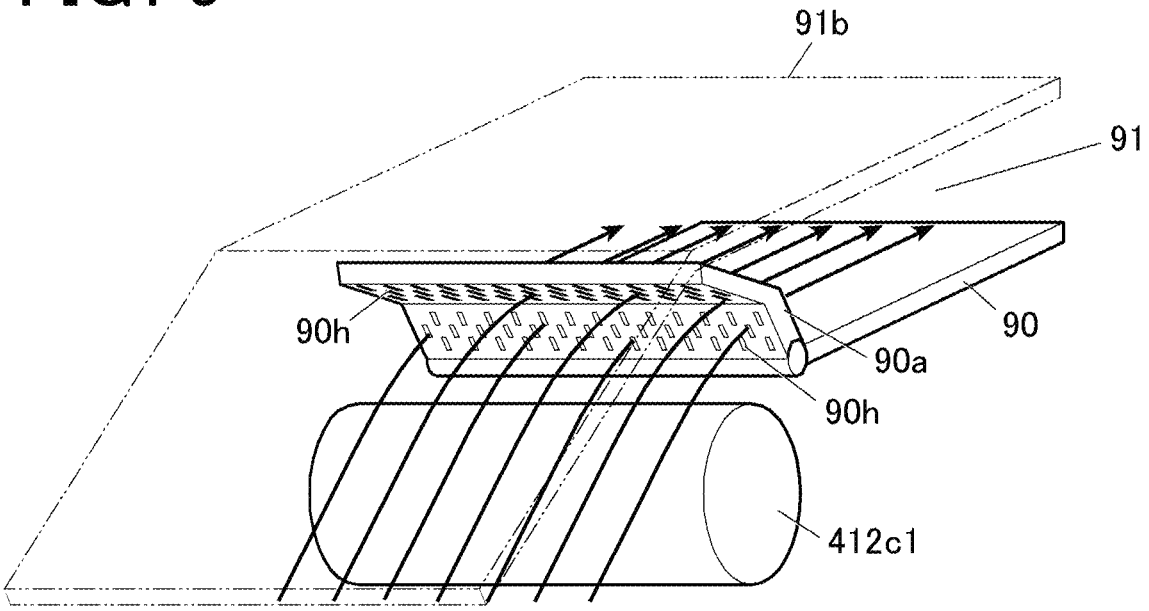
FIG. 9 is a perspective view of a structure of suction from a developing device.
Figure 10:
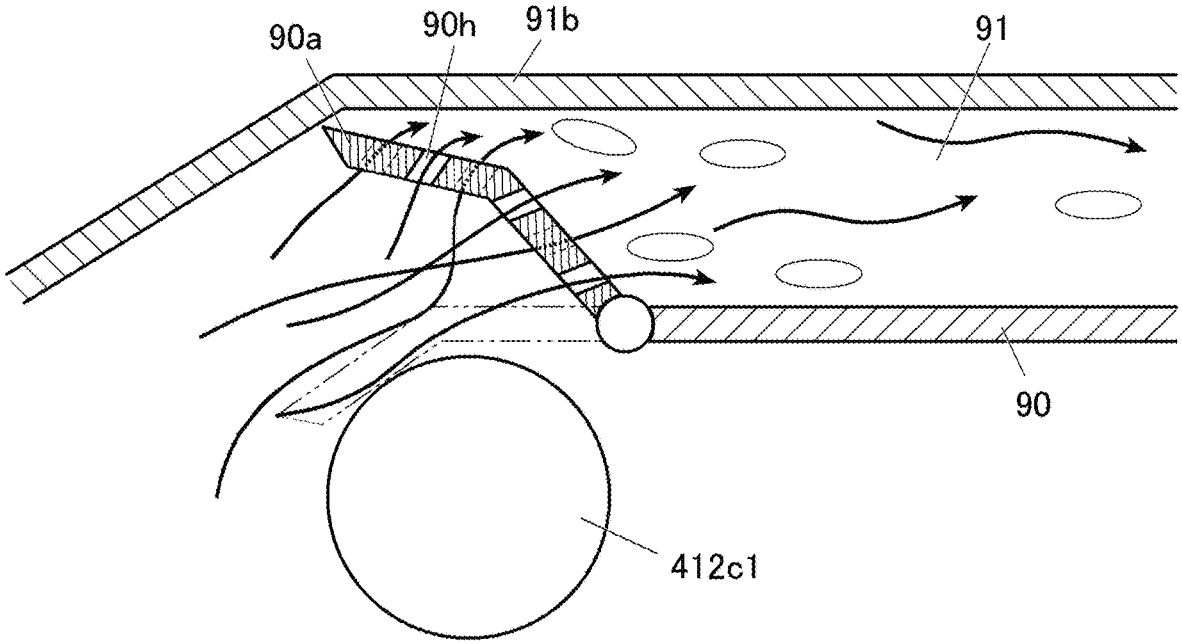
FIG. 10 is a cross-sectional view of a structure of suction from a developing device.

For one thing, the movable portion 90*a* includes air vent holes 90*h* as shown in FIGS. 8 to 10, and the first suction path is not different from the above example as shown in FIG. 8, but the second suction path is a path passing through the air vent holes 90*h* as shown in FIGS. 9 and 10.

The air vent holes 90*h* are dotted on the movable portion 90*a*. This makes it easier for the airflow to work on each part of the movable portion 90*a* during suction. It is thus easier to suck and remove the developer by ripping off from the movable portion 90*a*. As the air vent holes 90*h* are provided on the movable portion 90*a*, the space produced between the end of the movable portion 90*a* and the upper face member 91*b* when the movable portion 90*a* is at the second position may be closed so that ventilation is impossible, or may be left for ventilation during suction.

Figure 11:
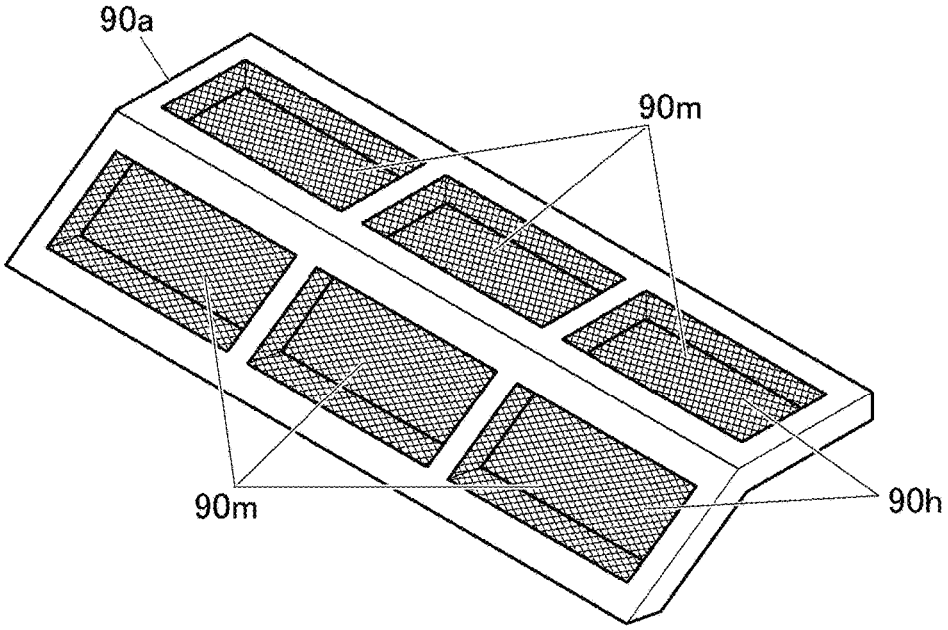
FIG. 11 is a perspective view of a movable portion with a mesh structure.

In order to provide the vent holes 90*h* on the movable portion 90*a*, the movable portion 90*a* may have a mesh structure 90*m* with the air vent holes 90*h* as shown in FIG. 11.

Figure 12:
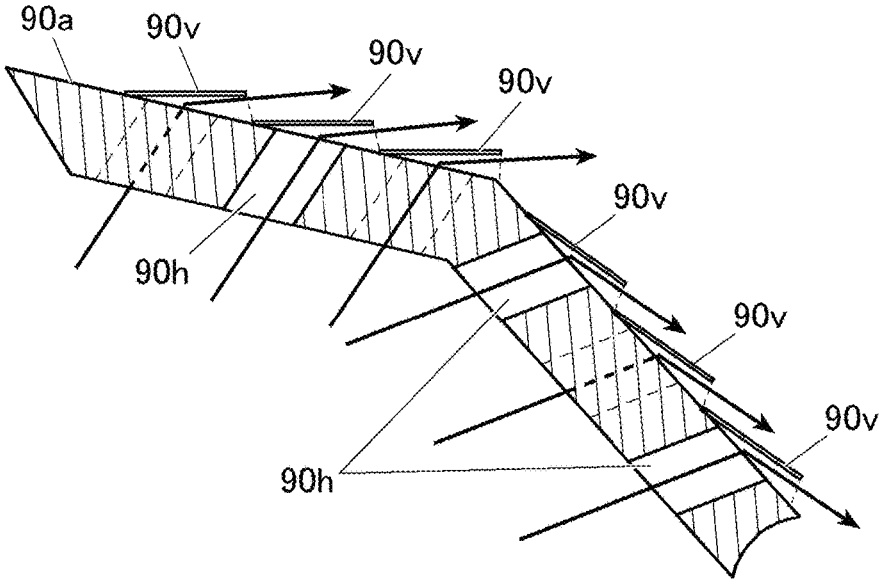
FIG. 12 is a cross-sectional view of a movable portion with check valves.

Check valves 90*v* that prevent backflow against the ventilation direction in the suction mode may be provided on the air vent holes 90*h*, as shown in FIG. 12. This can prevent the developer from flowing back through the air vent holes 90*h* and falling into the internal space 94 again.

Figure 13:
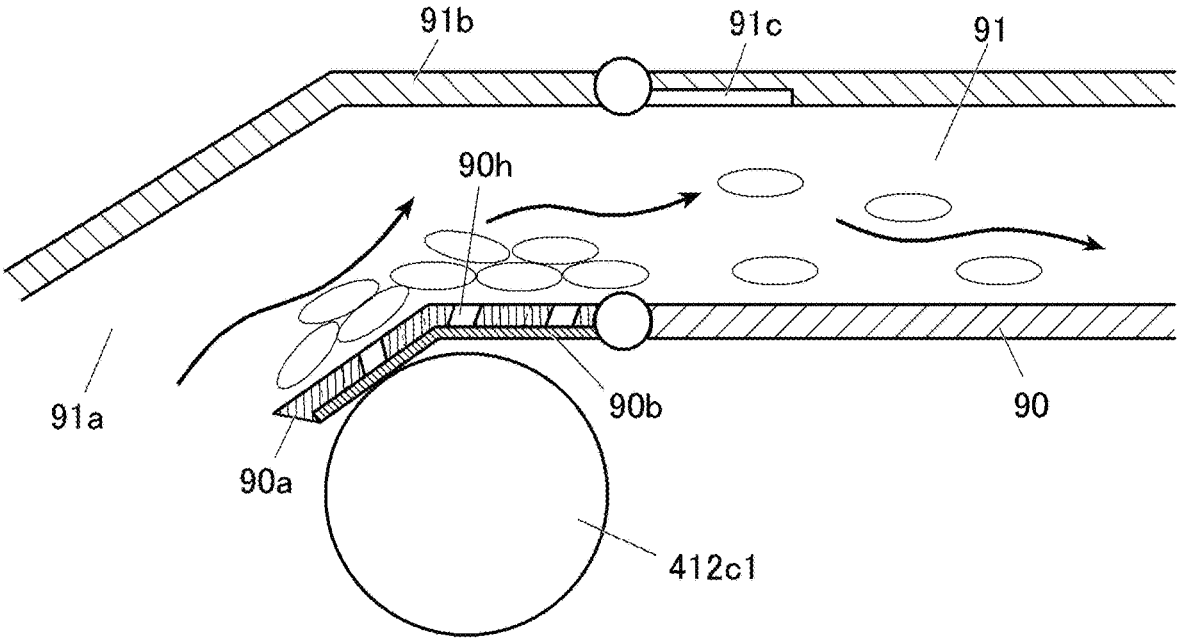
FIG. 13 is a cross-sectional view of a structure of suction from a developing device.

The fume prevention plate 90 may include a fixed portion 90*b* that closes the air vent holes 90*h* when the movable portion 90*a* is at the first position, as shown in FIG. 13. This can limit the suction to that through the suction inlet 91*a* above the developing rollers 412*a, b* and omit the air vent holes 90*h* from the suction path when the movable portion 90*a* is at the first position.

Figure 14:
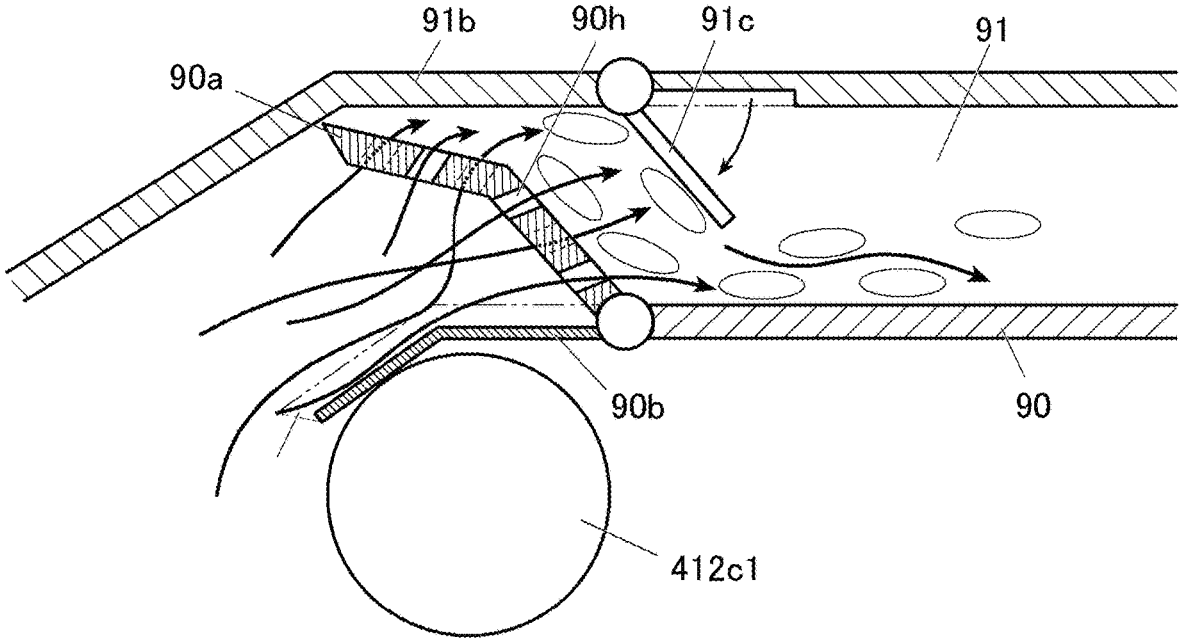
FIG. 14 is a cross-sectional view of a structure of suction from a developing device.

When the movable portion 90*a* is at the second position as shown in FIG. 14, the air vent holes 90*h* are separate from the fixed portion 90*b*, enabling ventilation.

The fixed portion 90*b* may coexist with the check valves 90*v*.

An auxiliary movable portion 91*c* that is raised toward the center of the suction duct 91 may be provided on the suction duct as shown in FIG. 14, and thereby making the cross-sectional area of the flow path of the movable portion 90*a* changeable.

In that case, the controller 100 reduces the cross-sectional area of the flow path of the above-described downstream part by the auxiliary movable portion 91*c* extended when the movable portion 90*a* is at the second position (FIG. 14) in comparison to when the movable portion 90*a* is at the first position (FIG. 13), increasing the suction force placed by the air suction device 92 on the movable portion 90*a*. This makes it possible to suck and remove the developer accumulated on the movable portion 90*a* efficiently and effectively.

The restricting mechanism that can change the cross-sectional area of the flow path is not limited to the illustrated example, and a flexible portion may be provided to restrict the area, for example. However, preferably, the upper part of the area of the flow path of the suction duct 91 is restricted and the lower part is not restricted as shown in FIG. 14. That is because the developer falling from the movable portion 90*a* easily flows toward the air suction device 92.

Figure 15:
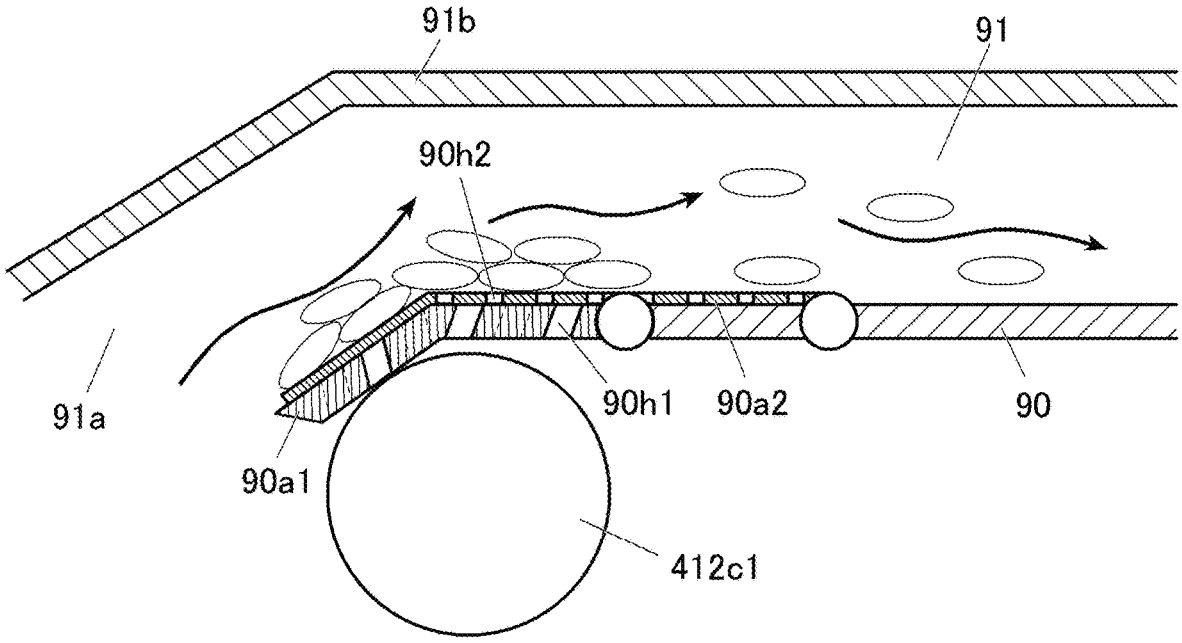
FIG. 15 is a cross-sectional view of a structure of suction from a developing device.

The movable portion may consist of a first movable portion 90*a*1 and a second movable portion 90*a*2 as shown in FIG. 15, and the first movable portion 90*a*1 and the second movable portion 90*a*2 may overlap each other when they are at the first position.

The first movable portion 90*a*1 and the second movable portion 90*a*2 have each air vent holes.

Figure 16:
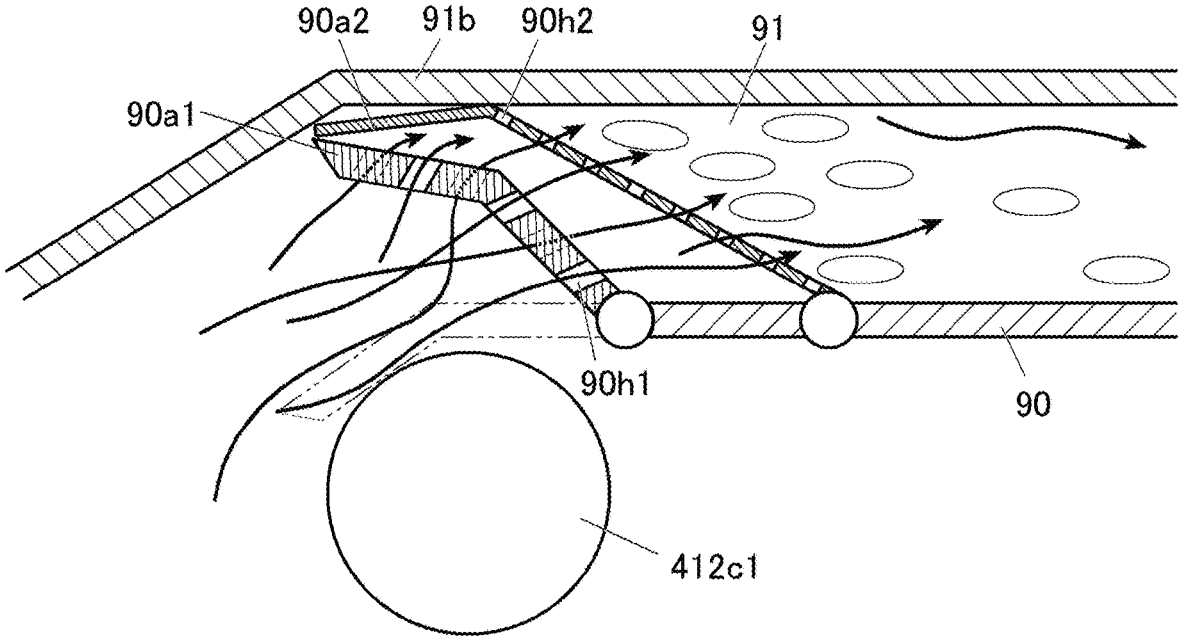
FIG. 16 is a cross-sectional view of a structure of suction from a developing device.

The second suction path passes through air vent hols 90*h*1 of the first movable portion 90*a* and air vent holes 90*h*2 of the movable portion 90*a*2 as shown in FIG. 16.

When the first movable portion 90*a*1 and the second movable portion 90*a*2 are at the first position as shown in FIG. 15, the air vent holes 90*h*1 of the first movable portion 90*a*1 are covered by the structure around the air vent holes 90*h*2 of the second movable portion 90*a*2, and the air vent holes 90*h*2 of the second movable portion 90*a*2 are covered by the structure around the air vent holes 90*h*1 of the first movable portion 90*a*1. That is, the air vent holes 90*h*1 and the air vent holes 90*h*2 do not communicate with each other. This makes it possible to limit the suction to that through the suction inlet 90*a* above the developing rollers 412*a, b* by closing the suction path through the movable portions 90*a*1, 90*a*2 when the movable portions 90*a*1, 90*a*2 are at the first position.

Specifically, the hinge fulcrum of the second movable portion 90*b* is separate from the hinge fulcrum of the first movable portion 90*a*1 in the suction direction, but the structure is not limited to this.

(Control Flow Example)

Figure 17:
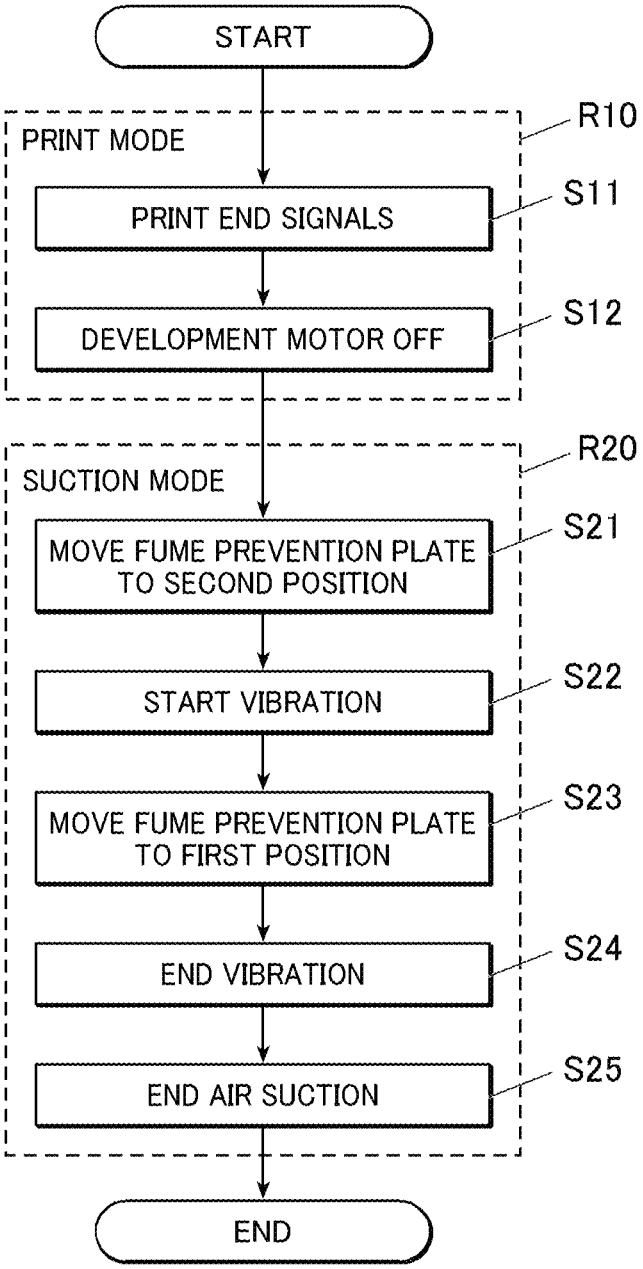
FIG. 17 is a flowchart showing control steps from a print mode to a suction mode.

Next, an example of the control flow from the print mode to the suction mode by the controller 100 is described with reference to the flowchart of FIG. 17.

If the controller 100 detects a print end signal in a print mode R10 where the image formation is performed (S11), the controller 100 turns off the development motor and stops an action of the developing device 412 (S12).

Next, the controller 100 operates the air suction device 92 and proceeds to a suction mode R20. If the air suction device 92 is already in operation, the air suction device 92 continues to be in operation. In the case where the suction output in the print mode R10 is different from that in the suction mode R20, the controller 100 specifies the suction output of the air suction device 92 to that in the suction mode R20. Especially, the suction output in the suction mode R20 is preferably high.

Here, as described above, each of the developing devices 412 that needs to be cleaned by the suction mode individually undergoes the suction mode. For example, if it is determined that the developing devices 412Y, 412M, and 412C need to undergo the suction mode at some timing, each of the developing devices 412Y, 412M, and 412C individually undergoes the suction mode one by one.

After proceeding to the suction mode R20, the controller 100 moves the movable portion 90*a* of the fume prevention plate 90 to the second position (S21).

After moving the movable portion 90*a* to the second position, the controller 100 starts vibration application by the above-described vibrating device 95 (S22).

After a predetermined time elapsed, the controller 100 moves the movable portion 90 of the fume prevention plate 90 to the first position (S23), ends the vibration application with the vibrating device 95 (S24), stops the air suction device 92 (S25), ends the suction mode R20, and then proceeds to the standby state. When the suction mode R20 is ended, the closing valves 93Y, 93M, and 93K are all opened for the suction in the print mode R10.

If an unprocessed print job has been already input, the process proceeds to the print mode R10. In that case, the closing valves 93Y, 93M, 93C, and 93K are all opened, and the air suction device 92 continues to be in operation (In the case where the suction output in the print mode R10 is different from that in the suction mode R20, the controller 100 specifies the suction output of the air suction device 92 to that in the print mode R10).

If a new print job is input after ending the suction mode R20 and proceeding to the standby state, the controller 100 operates the air suction device 92 for the suction in the print mode R10.

As described hereinbefore, in this embodiment, the developer scattering inside the developing device 412 by the development operation can be sucked and removed, and the developer accumulated on the fume prevention plate 90 can be removed efficiently and effectively. This makes it possible to keep the image quality good.

The scope of the present invention is not limited to the above-described embodiment, and includes various modifications within the scope of the claims of the present invention.

In the above-described embodiment, the position of the movable portion 90*a* is controlled by the controller, but may be changed only manually. It is possible that a service person uses the mechanism to change the position in maintenance.

What is claimed is:

1. An image forming apparatus comprising:

an image carrier;

an exposure device that forms an electrostatic latent image on the image carrier;

a developing device that supplies, using a developing roller facing the image carrier, a developer to the electrostatic latent image formed on the image carrier to form a toner image; and a hardware processor that controls the image carrier, the exposure device, and the developing device, wherein the image forming apparatus further includes:

a fume prevention plate that covers a part of an internal space of the developing device where the developing roller is disposed and the developer is stored and that prevents the developer from scattering outside from the internal space;

a suction duct; and an air suction device, wherein an inlet end of the suction duct is positioned adjacent to the internal space and an outlet end of the suction duct is in communication with the air suction device, wherein the fume prevention plate includes a movable portion positioned at the inlet end of the suction duct and extending into the internal space, wherein a position of the movable portion can be changed between a first position and a second position different from the first position.

2. The image forming apparatus according to claim 1, wherein the hardware processor controls the position of the movable portion such that the movable portion is at the first position or the second position.

3. The image forming apparatus according to claim 2, wherein the hardware processor controls image formation and controls a suction mode to suck the internal space through the suction duct by the air suction device except at a time of the image formation, wherein the hardware processor executes the image formation only when the movable portion is at the first position, and moves the movable portion to the second position during the suction mode.

4. The image forming apparatus according to claim 3, wherein the hardware processor moves the movable portion only during the suction mode.

5. The image forming apparatus according to claim 3, wherein the hardware processor moves the movable portion from the second position toward the first position and then toward the second position back again one time or multiple times during the suction mode.

6. The image forming apparatus according to claim 3, wherein the hardware processor stops the air suction device at an end of the suction mode.

7. The image forming apparatus according to claim 3, wherein the developing device includes multiple developing devices, wherein the hardware processor executes the suction mode individually for each of the multiple developing devices.

8. The image forming apparatus according to claim 3, further comprising:

a vibrating device that applies vibration to the developing device, wherein the hardware processor causes the vibrating device to apply vibration to the developing device during the suction mode.

9. The image forming apparatus according to claim 3, wherein a first suction path of the suction duct that is open when the movable portion is at the first position is different from a second suction path of the suction duct that is open when the movable portion is at the second position.

10. The image forming apparatus according to claim 9, wherein the movable portion includes an air vent hole, wherein the second suction path is through the air vent hole.

11. The image forming apparatus according to claim 10, wherein the movable portion includes a mesh structure with the air vent hole.

12. The image forming apparatus according to claim 10, wherein a check valve that prevents backflow against a ventilation direction during the suction mode is provided on the air vent hole.

13. The image forming apparatus according to claim 10, wherein the fume prevention plate includes a fixing portion that closes the air vent hole when the movable portion is at the first position, wherein the air vent hole is separate from the fixing portion for ventilation when the movable portion is at the second position.

14. The image forming apparatus according to claim 10, wherein the movable portion includes a first movable portion and a second movable portion, wherein the first movable portion and the second movable portion overlap with each other when the movable portion is at the first position.

15. The image forming apparatus according to claim 14, wherein each of the first movable portion and the second movable portion includes the air vent hole, wherein the second suction path is through the air vent hole of the first movable portion and the air vent hole of the second movable portion, wherein when the first movable portion and the second movable portion are at the first position, the air vent hole of the first movable portion is covered by a peripheral structure of the air vent hole of the second movable portion, and the air vent hole of the second movable portion is covered by a peripheral structure of the air vent hole of the first movable portion.

16. The image forming apparatus according to claim 1, wherein a cross-sectional area of a flow path of the suction duct on a downstream side with respect to the movable portion is changeable, wherein the hardware processor reduces the cross-sectional area of the flow path of the suction duct on the downstream side when the movable portion is at the second position in comparison to when the movable portion is at the first position, increasing a suction force placed on the movable portion by the air suction device.

17. The image forming apparatus according to claim 1, further comprising:

a developer carrier that carries the developer by a magnetic force and that is disposed in the internal space, wherein the movable portion is disposed along the developer carrier when the movable portion is at the first position.

18. The image forming apparatus according to claim 17, wherein a suction path of the suction duct is on an opposite side of the developer carrier with the fume prevention plate in between when the movable portion is at the first position.

19. The image forming apparatus according to claim 17, wherein the movable portion is more separate from the developer carrier when the movable portion is at the second position than when the movable portion is at the first position.

* * * * *